US011161121B2

(12) United States Patent
Brinkmann et al.

(10) Patent No.: US 11,161,121 B2
(45) Date of Patent: Nov. 2, 2021

(54) CUTTING BLADE ASSEMBLY

(71) Applicant: Jung Pumpen GmbH, Steinhagen (DE)

(72) Inventors: Nils Brinkmann, Steinhagen (DE); Carsten Vogt, Herford (DE)

(73) Assignee: Jung Pumpen GmbH, Steinhagen (DE)

( * ) Notice: Subject to any disclaimer, the term of this patent is extended or adjusted under 35 U.S.C. 154(b) by 180 days.

(21) Appl. No.: 16/408,893

(22) Filed: May 10, 2019

(65) Prior Publication Data

US 2020/0353475 A1 Nov. 12, 2020

(51) Int. Cl.

| | |
|---|---|
| ***B02C 18/24*** | (2006.01) |
| ***B02C 18/06*** | (2006.01) |
| ***B02C 18/18*** | (2006.01) |

(52) U.S. Cl.

CPC ..... *B02C 18/062* (2013.01); *B02C 18/182* (2013.01); *B02C 18/24* (2013.01)

(58) Field of Classification Search

CPC . B02C 18/062; B02C 18/182; B02C 18/0092; F04D 7/045; F04C 2/00

See application file for complete search history.

(56) References Cited

U.S. PATENT DOCUMENTS

| | | | | |
|---|---|---|---|---|
| 1,713,037 | A | 5/1929 | Ellis | |
| 2,103,896 | A | 12/1937 | Doyle et al. | |
| 2,259,623 | A | 10/1941 | Dieckmann | |
| 2,496,359 | A | 2/1950 | Walter | |
| 2,672,075 | A * | 3/1954 | Fraser | D21D 1/32 241/43 |
| 3,073,535 | A | 1/1963 | Vokes | |
| 3,128,051 | A | 4/1964 | Smith | |
| 3,155,046 | A | 11/1964 | Vaughan | |
| 3,169,486 | A | 2/1965 | Freed | |

(Continued)

FOREIGN PATENT DOCUMENTS

| | | |
|---|---|---|
| DE | 102008057233 A1 | 5/2010 |
| EP | 2147213 B1 | 1/2016 |

(Continued)

OTHER PUBLICATIONS

U.S. Pat. No. 970593; issue date Sep. 20, 1910; W.B. Yeakel, Inventor.

(Continued)

*Primary Examiner* — Faye Francis

(74) *Attorney, Agent, or Firm* — Husch Blackwell LLP

(57) ABSTRACT

Embodiments of the invention provide a cutting blade assembly operably coupleable to a fluid pump. The cutting blade assembly comprises a cutting plate and a cutting hub. The cutting plate may have a front axial surface, an opening, and a plurality of cutting features. Each of the plurality of cutting features may define a pair of cutting edges. The cutting hub may be disposed at least partially within the opening of the cutting plate and may have a cutting arm and fin adjacent to the front axial surface. The cutting arm may define an arcuate front surface having a leading edge. When the cutting plate and the cutting hub are rotated relative to each other, the leading edge of the cutting arm may pass adjacent to the plurality of cutting features so that the relative rotation of the cutting plate and the cutting hub defines a cutting action between the cutting arm and each cutting feature.

10 Claims, 11 Drawing Sheets

(56) References Cited

U.S. PATENT DOCUMENTS

| | | | | |
|---|---|---|---|---|
| 3,323,650 | A * | 6/1967 | Kilbane, Jr. | C02F 1/686 210/173 |
| 3,325,107 | A | 6/1967 | Peterson | |
| 3,380,669 | A | 4/1968 | Hatton | |
| 3,380,673 | A | 4/1968 | Lenten et al. | |
| 3,444,818 | A | 5/1969 | Sutton | |
| 3,560,106 | A | 2/1971 | Sahlstrom | |
| 3,650,481 | A | 3/1972 | Conery et al. | |
| 3,658,262 | A | 4/1972 | Burant, Jr. | |
| 3,692,422 | A | 9/1972 | Girardier | |
| 3,738,581 | A | 6/1973 | Gallauresi et al. | |
| 3,843,063 | A | 10/1974 | Honeyman | |
| 3,889,885 | A | 6/1975 | Couture | |
| RE28,677 | E | 1/1976 | Blakley et al. | |
| 3,973,866 | A | 8/1976 | Vaughan | |
| 4,074,869 | A | 2/1978 | Johnson | |
| 4,108,386 | A | 8/1978 | Conery et al. | |
| 4,109,872 | A | 8/1978 | Couture | |
| 4,141,510 | A | 2/1979 | Smith | |
| 4,145,008 | A | 3/1979 | Wolford | |
| 4,378,093 | A | 3/1983 | Keener | |
| 4,402,648 | A | 9/1983 | Kretschmer | |
| 4,456,424 | A | 6/1984 | Araoka | |
| 4,480,796 | A | 11/1984 | Paraskevas | |
| 4,640,666 | A | 2/1987 | Sodergard | |
| 4,778,336 | A | 10/1988 | Husain | |
| 4,842,479 | A | 6/1989 | Dorsch | |
| 4,911,368 | A | 3/1990 | Nishimori | |
| 5,016,825 | A | 5/1991 | Carpenter | |
| 5,076,757 | A | 12/1991 | Dorsch | |
| 5,213,469 | A | 5/1993 | Mitsch et al. | |
| 5,256,032 | A | 10/1993 | Dorsch | |
| 5,346,143 | A | 9/1994 | Askin | |
| 5,456,580 | A | 10/1995 | Dorsch | |
| 5,460,482 | A | 10/1995 | Dorsch | |
| 5,531,385 | A | 7/1996 | Witsken | |
| 5,707,016 | A | 1/1998 | Witsken | |
| 6,190,121 | B1 | 2/2001 | Hayward et al. | |
| 6,224,331 | B1 | 5/2001 | Hayward et al. | |
| 7,080,797 | B2 | 7/2006 | Doering et al. | |
| 7,114,925 | B2 | 10/2006 | Shaw | |
| 7,118,327 | B2 | 10/2006 | Doering et al. | |
| 7,159,806 | B1 | 1/2007 | Ritsema | |
| 7,234,657 | B2 | 6/2007 | Doering et al. | |
| 7,237,736 | B1 | 7/2007 | Martin | |
| 7,455,251 | B2 | 11/2008 | Doering et al. | |
| 7,520,454 | B2 | 4/2009 | Zelder et al. | |
| 7,584,916 | B2 | 9/2009 | Shaw | |
| 7,841,826 | B1 | 11/2010 | Phillips | |
| 7,841,827 | B2 | 11/2010 | Keener | |
| 7,967,553 | B2 | 6/2011 | Wagner | |
| 8,105,017 | B2 | 1/2012 | Dorsch et al. | |
| 8,109,714 | B2 | 2/2012 | Keener | |
| 8,267,643 | B2 * | 9/2012 | Wagner | F04D 7/045 415/121.1 |
| 8,366,384 | B2 | 2/2013 | Sodergard | |
| 8,562,287 | B2 | 10/2013 | Schmidt et al. | |
| 8,657,564 | B2 | 2/2014 | Cuppetelli | |
| 9,004,381 | B2 | 4/2015 | Schmidt et al. | |
| 9,073,056 | B2 * | 7/2015 | Abeln | B02C 18/062 |
| 9,352,327 | B2 | 5/2016 | Schmidt et al. | |
| 9,475,059 | B2 | 10/2016 | Vallen | |
| 9,719,515 | B2 | 8/2017 | Pohler | |
| 10,054,136 | B2 | 8/2018 | Sowa et al. | |
| 10,267,312 | B2 | 4/2019 | Pohler | |
| 10,280,933 | B2 | 5/2019 | Sowa et al. | |
| 10,316,846 | B2 | 6/2019 | Davis | |
| 2009/0092479 | A1 | 4/2009 | Wagner | |
| 2010/0322756 | A1 | 12/2010 | Schmidt | |
| 2013/0108411 | A1 * | 5/2013 | Ciotola | B02C 18/0092 415/1 |
| 2013/0270375 | A1 | 10/2013 | Schmidt et al. | |
| 2016/0208812 | A1 | 7/2016 | Sowa et al. | |
| 2016/0363123 | A1 | 12/2016 | Davis | |
| 2017/0306965 | A1 | 10/2017 | Bveington | |
| 2018/0202453 | A1 | 7/2018 | Pohler | |

FOREIGN PATENT DOCUMENTS

| | | | |
|---|---|---|---|
| EP | 3042082 | A1 | 7/2016 |
| EP | 2535589 | A3 | 3/2018 |
| EP | 3309401 | A1 | 4/2018 |
| EP | 3312426 | A1 | 4/2018 |
| GB | 2128102 | A | 4/1984 |
| WO | 20140145910 | A1 | 9/2014 |
| WO | 2015032609 | A1 | 3/2015 |
| WO | 2018073136 | A1 | 4/2018 |
| WO | 2018073137 | A1 | 4/2018 |
| WO | 2018100488 | A1 | 6/2018 |

OTHER PUBLICATIONS

Liberty Pumps; LSG200-Series; Omnivore Grinders; Copyright Liberty Pumps, Inc. 2011; 4 pages.

Jung Pumpen; G2DT/G2D Series; Commercial Grinder; Pentair Water; www.femyers.com (May 2011); 2 pages.

Zoeller Pump Company; The Shark Series; 840 Grinder Pump; copyright 2014 Zoeller Co.; 4 pages.

Zoeller Pump Company; The Shark Series; 915 Grinder Package; copyright 2013 Zoeller Co.; 2 pages.

Zoeller Pump Company; The Shark Series; 841 & 842 Grinder Pumps; copyright 2014 Zoeller Co.; 2 pages.

Frontline Industries, Inc.; Shredder Pump; <www.frontlineindustries.com/news-and-media/image-gallery/shredder-pump>; Oct. 16, 2014; 2 pages.

Extended European Search Report, European Application No. 19177599.8, dated Nov. 19, 2019, 6 pages.

* cited by examiner

CUTTING BLADE ASSEMBLY

REFERENCE TO RELATED APPLICATION

Not Applicable.

BACKGROUND OF THE INVENTION

Cutting blade assemblies are used in a wide variety of applications to generally reduce the particle size of the medium being processed. Grinder pumps include a motor that rotates an impeller and an associated cutting blade assembly. Fluid and debris suspended within the fluid are drawn into the grinder pump where the cutting blade assembly attempts to reduce the particle size of the suspended debris before the impeller pumps the resulting slurry to a downstream location.

One issue common to most cutting blade assemblies, and especially those incorporated in a grinder pump or other fluid pumping applications, is the efficient processing and jam-free operation of the cutting blade assembly given the wide variety of debris encountered. For instance, with grinder pumps, debris including rags, mop heads, beverage containers, diapers, coins, and other objects can clog and jam the cutting blade assembly or place an increased load on the motor driving the cutting blade assembly. The various types of debris present many challenges because stringy debris (e.g., a mop head) can tend to wrap around the cutting blade assembly, resilient debris (e.g., plastic and rubber objects) can tend to wedge between moving parts of the cutting blade assembly, and hard debris (e.g., metallic objects) can wear or damage the cutting features of the cutting blade assembly. One particularly pervasive global problem faced in cutting systems involves the processing of wastewater containing wipes, which can include fibrous materials such as plastic fibers. Fibers can accumulate in gaps and at various interfaces causing a reduction in effectiveness of the cutting system and blockages of the pump.

To address these various problems associated with processing a variety of suspended debris, the drive motor torque can be increased, the cutting blade assembly strengthened, and the allowable particle size increased. However, none of these approaches presents an efficient, cohesive technique to address the persistent issues faced by cutting blade assemblies, and especially those cutting blade assemblies used in grinder pump applications.

SUMMARY OF THE INVENTION

In light of at least the above, a need exists for a cutting blade assembly capable of efficiently and effectively processing various types of debris encountered by the cutting blade assembly.

Some embodiments of the invention provide a cutting blade assembly that may be operably coupleable to a fluid pump. The cutting blade assembly comprises a cutting plate and a cutting hub. The cutting plate may have a front axial surface, an opening, and a plurality of cutting features. Each of the plurality of cutting features may define a pair of cutting edges. The cutting hub may be disposed at least partially within the opening of the cutting plate and may have a cutting arm adjacent to the front axial surface. The cutting arm may define an arcuate front surface having a leading edge. When the cutting plate and the cutting hub are rotated relative to each other, the leading edge of the cutting arm may pass adjacent to the plurality of cutting features so that the relative rotation of the cutting plate and the cutting hub defines a cutting action between the leading edge of the cutting arm and the pair of cutting edges of each cutting feature.

The pair of cutting edges may be radially separated from each other, thereby allowing for multiple cuttings actions to be defined each time the leading edge of the cutting arm passes over an individual cutting feature of the plurality of cutting features. The pair of cutting edges may include a radially inner cutting edge and/or a radially outer cutting edge, and the multiple cutting actions may include: a scissor-type cutting action as the leading edge of the cutting arm passes the radially inner cutting edge; and/or a chipping-type cutting action as the leading edge of the cutting arm passes the radially outer cutting edge.

Each cutting feature of the plurality of cutting features may comprise a C-shaped through hole extending through the cutting plate from the front axial surface to a rear axial surface of the cutting plate.

Each cutting feature of the plurality of cutting features may be approximately equidistant from the opening and a radial edge of the cutting plate.

The cutting plate may include a plurality of deflection features configured to deflect debris radially outward away from the opening when the cutting hub is rotated relative to the cutting plate. Each of the deflection features may be gradually recessed into the front axial surface from an arcuate leading edge that is flush with the front axial surface to an arcuate trailing edge that is recessed into the front axial surface, thereby forming an angled lower surface. Each of the deflection features may include an inner end proximate the opening and an outer end at a radial edge of the cutting plate, and each of the deflection features may gradually widen from the inner end to the outer end. The arcuate leading edge may define a leading radius of curvature and the arcuate trailing edge may define a trailing radius of curvature that is different from the leading radius of curvature.

The cutting hub may further include a plurality of deflection fins configured to urge debris away from the opening of the cutting plate when the cutting hub rotates with respect to the cutting plate.

Other embodiments of the invention provide a cutting blade assembly that may be operably coupleable to a fluid pump. The cutting blade assembly comprises a cutting plate and a cutting hub. The cutting plate may have a front axial surface, an opening, and a plurality of cutting holes. Each of the plurality of cutting holes may define at least one cutting edge. The cutting hub may be disposed at least partially within the opening of the cutting plate and has a cutting arm and a fin. The cutting arm may be adjacent to the front axial surface and may define an arcuate front surface having a leading edge. The fin may be adjacent to the front axial surface and proximate to the cutting arm. When the cutting plate and the cutting hub are rotated relative to each other, the leading edge of the cutting arm may pass adjacent to the plurality of cutting holes so that the relative rotation of the cutting plate and the cutting hub defines a cutting action between the leading edge and the at least one cutting edge and the fins may be configured to urge debris away from the opening of the cutting plate.

The at least one cutting edge may be a pair of cutting edges. The pair of cutting edges may be radially separated from each other, thereby allowing for multiple cuttings actions to be defined each time the leading edge of the cutting arm passes over an individual cutting feature of the plurality of cutting features. Each cutting feature of the plurality of cutting features may comprise a C-shaped through hole extending through the cutting plate from the front axial surface to a rear axial surface of the cutting plate. Each cutting feature of the plurality of cutting features may be approximately equidistant from the opening and a radial edge of the cutting plate. Each one of the pair of cutting edges may be disposed on opposite ends of the corresponding cutting feature.

The cutting plate may further include a plurality of deflection features configured to deflect debris radially outward away from the opening when the cutting hub is rotated relative to the cutting plate. Each of the deflection features may be gradually recessed into the front axial surface from an arcuate leading edge that is flush with the front axial surface to an arcuate trailing edge that is recessed into the front axial surface, thereby forming an angled lower surface. Each of the deflection features may include an inner end proximate the opening and an outer end at a radial edge of the cutting plate, and each of the deflection features may gradually widen from the inner end to the outer end. The arcuate leading edge may define a leading radius of curvature and the arcuate trailing edge defines a trailing radius of curvature that is different from the leading radius of curvature.

In other embodiments, a cutting plate may comprise a front axial surface, a rear axial surface spaced apart from the front axial surface, and a plurality of cutting features formed through the front axial surface and the rear axial surface, wherein each of the plurality of cutting features may define a pair of cutting edges.

In still further embodiments, a cutting hub may comprises a hub portion, at least one cutting arm extending radially outward from the hub portion, and at least one fin extending radially outward from the hub portion and circumferentially spaced from the at least one cutting arm.

DETAILED DESCRIPTION

Figure 1:
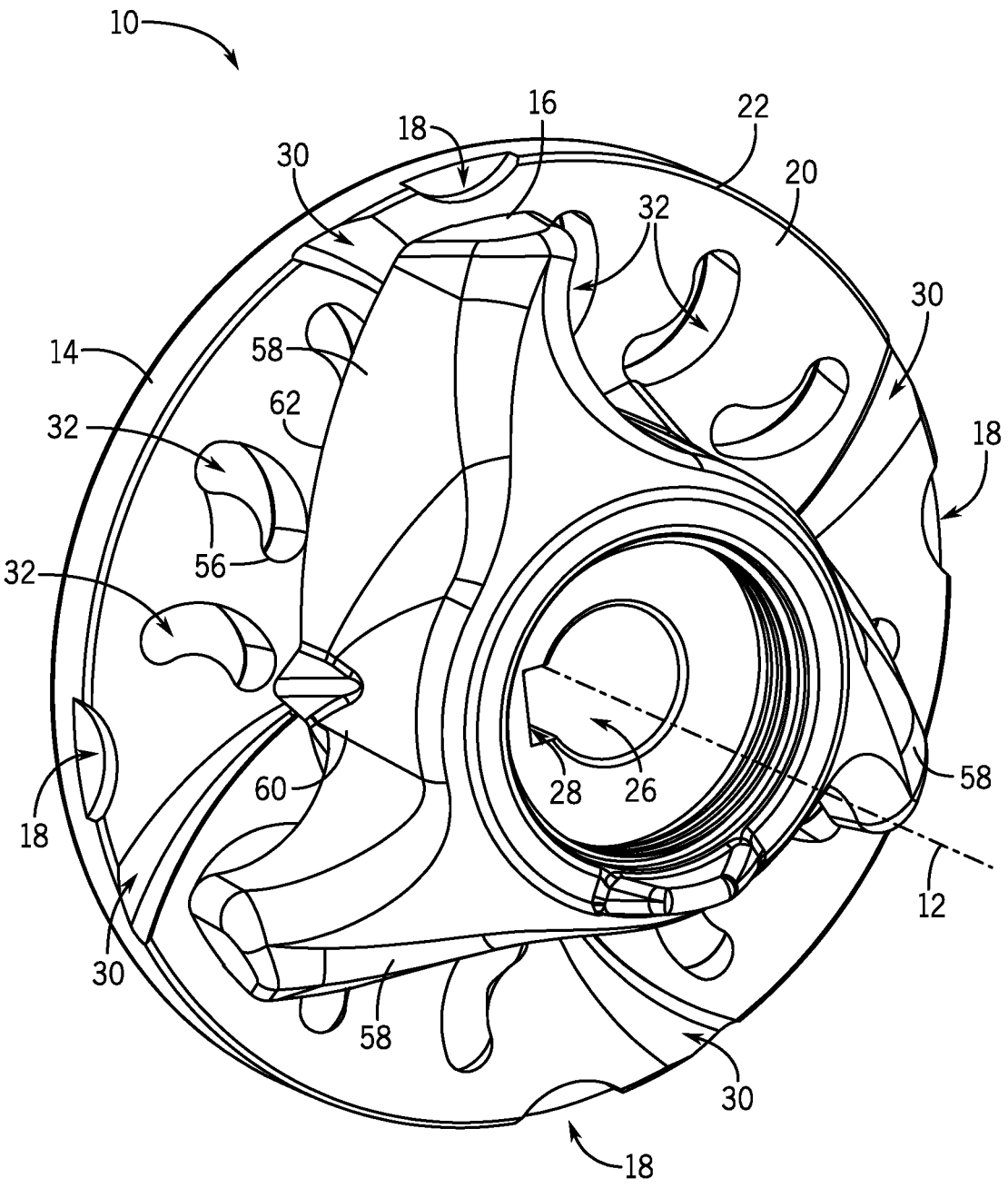
FIG. 1 is an isometric view of a cutting blade assembly according to one embodiment of the invention for a grinder pump.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

One embodiment of a cutting blade assembly 10 is described in the context of a grinder pump. However, the embodiments described herein can be incorporated into other suitable types of cutting devices, such as blenders, mixers, and food processors.

FIGS. 1-4 illustrate a cutting blade assembly 10 configured for use with a grinder pump (not shown). The grinder pump may include the cutting blade assembly 10 and a fluid pump. The grinder pump may generally draw fluid and debris into and through an inlet in a pump housing of the grinder pump. The fluid and debris may be processed by the cutting blade assembly 10 and the resulting slurry may be directed through the grinder pump, through an internal manifold, toward an outlet of the pump housing. Specifically, the fluid pump may include an electric motor configured to rotate a central drive shaft about a drive axis 12 (shown in FIG. 1). The drive shaft may be rotatably fixed to an impeller, which may be seated within the pump housing proximate the inlet. As the impeller rotates, fluid and debris may be drawn toward the inlet and engaged by the cutting blade assembly 10.

The cutting blade assembly 10 of one embodiment of the invention may include a disk-shaped cutting plate 14 and a cutting hub 16. In some instances, the cutting plate 14 may be seated into a mating cylindrical recess formed into an external surface of the pump housing and surrounding the inlet. The cutting plate 14 may be rotatably fixed to the mating cylindrical recess by a series of mating features that engage a corresponding plurality of rotational locking notches 18 of the cutting plate 14. Each locking notch 18 may be recessed into a front axial surface 20 of the cutting plate 14 at a radial edge 22 of the cutting plate 14. In some instances, the plurality of locking notches 18 may be disposed evenly-spaced around the circumference of the cutting plate 14.

The cutting hub 16 is partially received within a central opening 24 (shown in FIGS. 4, 6, and 7) of the cutting plate 14 and may be rotatably coupled to the drive shaft of the motor, so that the cutting hub 16 rotates in unison with the impeller of the fluid pump. Specifically, the cutting hub 16 includes a central opening 26 having a keyway 28 that may be configured to receive the drive shaft of the motor, and to engage the drive shaft of the motor in a keyway-type rotationally-engaged connection.

It will be appreciated that the cutting hub 16 may alternatively or additionally be configured to rotatably engage the drive shaft of the motor in various other manners without departing from the scope of the invention. For example, in some instances, the central opening 26 of the cutting hub 16 may alternatively include a threaded radially-inward facing surface configured to engage a corresponding threaded portion of the drive shaft.

FIGS. 1-12 illustrate the structure of and interaction between the cutting plate 14 and the cutting hub 16 of the cutting blade assembly 10. The cutting plate 14 and the cutting hub 16 are configured to establish an axial cutting action (i.e., generally parallel to the drive axis 12). This axial cutting action is achieved via relative rotation between the cutting plate 14 and the cutting hub 16.

Figure 7:
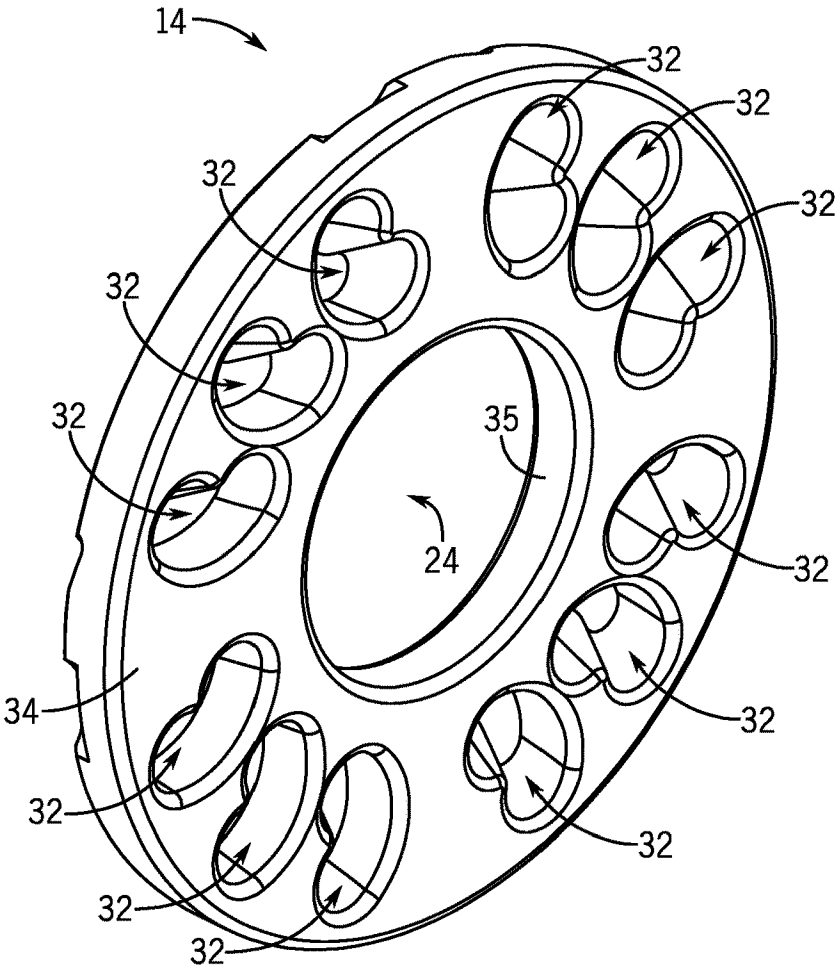
FIG. 7 is a rear isometric view of the cutting plate of FIG. 6.
Figure 6:
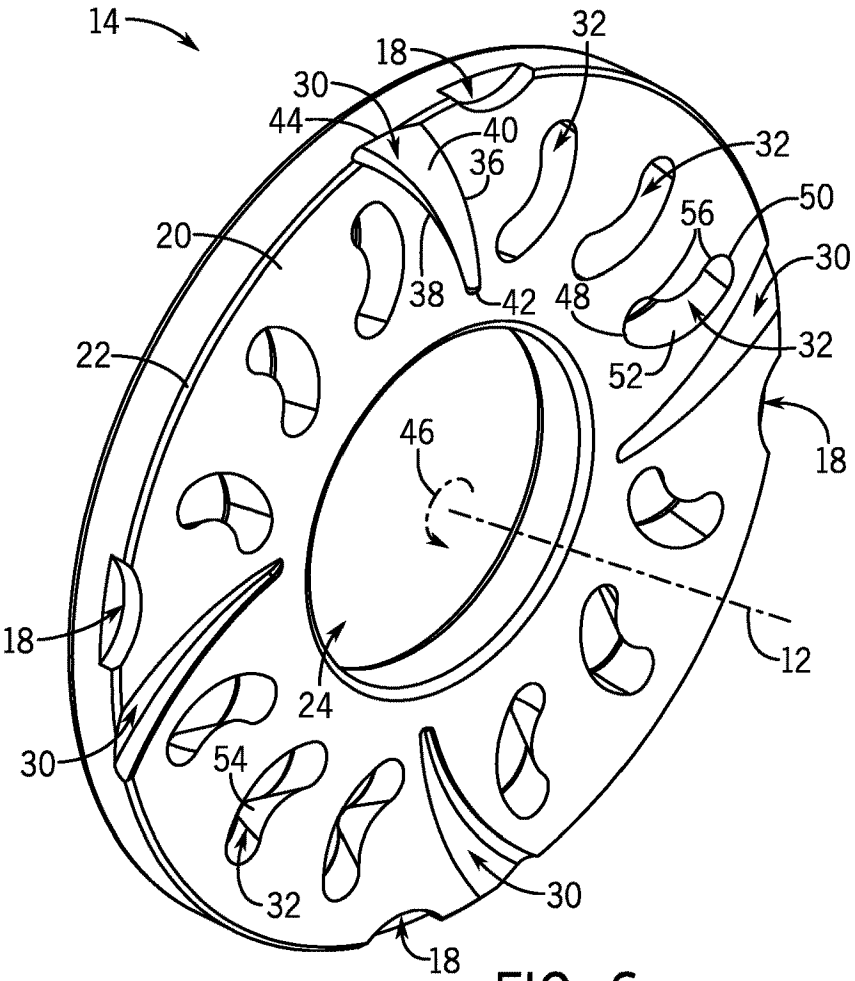
FIG. 6 is a front isometric view of a cutting plate of the cutting blade assembly of FIG. 1.

As shown in FIGS. 6 and 7, the cutting plate 14 includes the locking notches 18, the central opening 24, a plurality of deflection features 30, and a plurality of cutting features 32. The central opening 24 extends through the cutting plate 14 from the front axial surface 20 to a rear axial surface 34 (shown in FIG. 7) and defines an inwardly-facing radial wall 35.

In the illustrated non-limiting example, there may be four deflection features 30 that are evenly spaced around the circumference of the cutting plate 14. In other embodiments, the shape, number, and relative orientation of the deflection features 30 may be altered to accommodate application-specific requirements.

Each of the deflection features 30 may be gradually recessed into the front axial surface 20 from an arcuate leading edge 36 that is flush with the front axial surface 20 to an arcuate trailing edge 38 that is recessed into the front axial surface 20, thereby forming an angled lower surface 40. Each of the deflection features 30 may further include an inner end 42 proximate the central opening 24 and an outer end 44 at the radial edge 22 of the cutting plate 14.

Both the arcuate leading edge 36 and the arcuate trailing edge 38 may extend generally radially outward from the inner end 42 toward the outer end 44 and may curve from the inner end 42 to the outer end 44 in a direction of rotation 46 of the cutting hub 16 (i.e., the direction that the cutting hub 16 rotates relative to the cutting plate 14 during use). The arcuate trailing edge 38 may also have a smaller radius of curvature than that of the arcuate leading edge 36, such that the deflection features 30 gradually widen from the inner end 42 to the outer end 44. The increasing depth and flow area of the deflection features 30 may help to gradually deflect debris radially outward away from the central opening 24, when the cutting hub 16 is rotated relative to the cutting plate 14.

In the illustrated non-limiting example, there may be twelve cutting features 32 that may be grouped into four groups of three, each group may be evenly spaced around the circumference of the cutting plate 14 and may be separated by one of the four deflection features 30. In other embodiments, the shape, number, grouping, and relative orientation of the cutting features 32 may be altered to accommodate application-specific requirements.

Each of the cutting features 32 may form a generally arcuate or C-shaped through hole extending through the cutting plate 14 from the front axial surface 20 to the rear axial surface 34 and may be approximately equidistant from the central opening 24 and the radial edge 22 of the cutting plate 14. Each cutting feature 32 may include an inner end 48, an outer end 50, a leading sidewall 52, and a trailing sidewall 54. The inner end 48 may be disposed proximate the central opening 24. The outer end 50 may be disposed proximate the radial edge 22 of the cutting plate 14. Both the inner end 48 and the outer end 50 may be angled or skewed in the direction of rotation 46 of the cutting hub 16. As such, each of the leading sidewall 52 and the trailing sidewall 54, and therefore the cutting feature 32 as a whole, may form a generally C-shaped element with the concave side of the "C" shape pointing in the direction of rotation 46 of the cutting hub 16.

Figure 8:
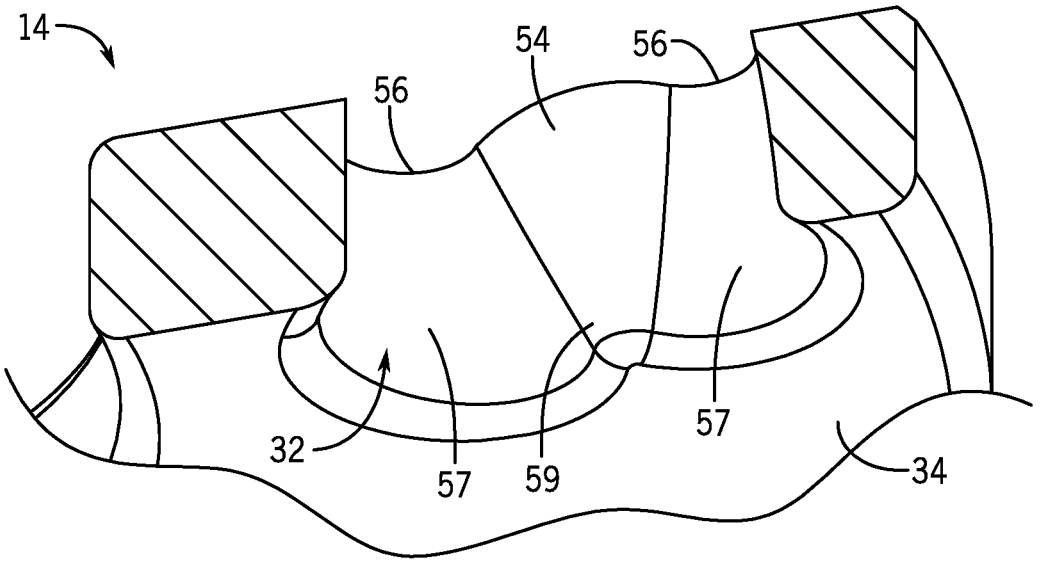
FIG. 8 is a cross-sectional view of the cutting plate, taken along line 8-8 of FIG. 4.
Figure 9:
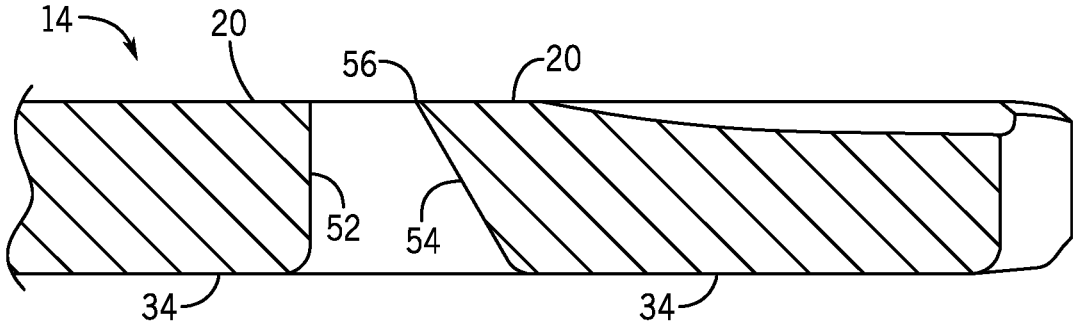
FIG. 9 is a cross-sectional view of the cutting plate, taken along line 9-9 of FIG. 4.
Figure 10:
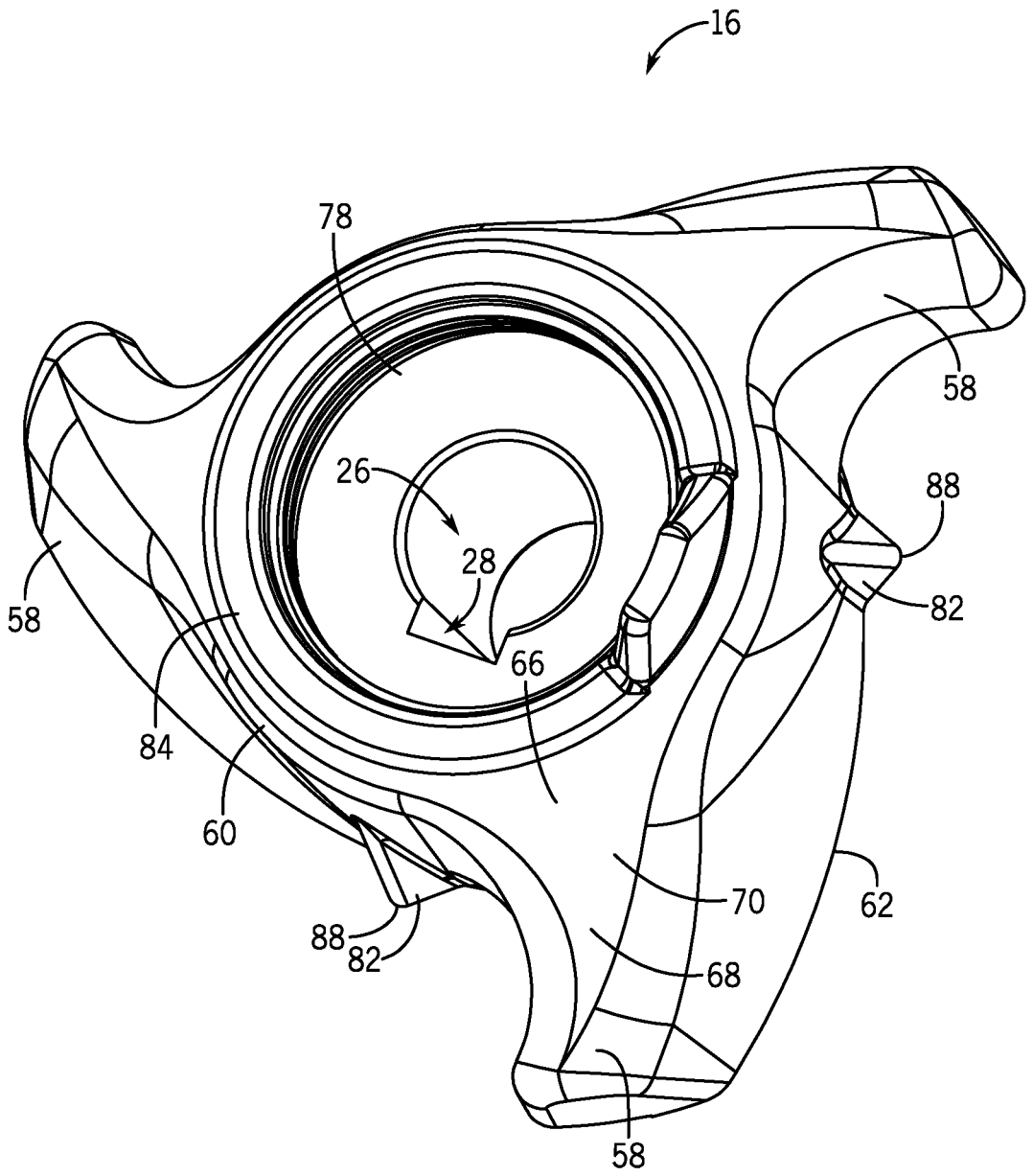
FIG. 10 is a front isometric view of a cutting hub of the cutting blade assembly of FIG. 1.
Figure 11:
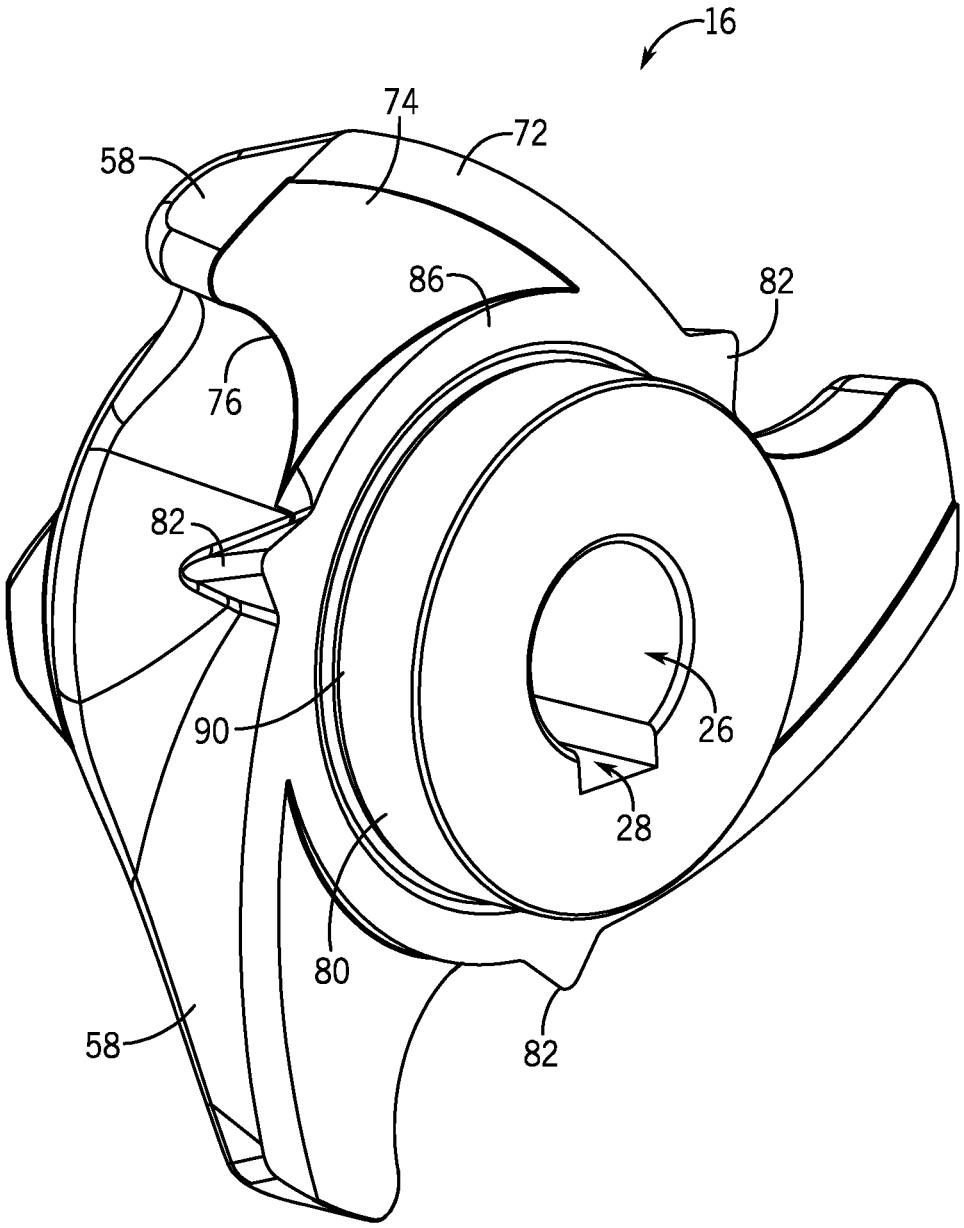
FIG. 11 is a rear isometric view of a cutting hub of the cutting blade assembly of FIG. 1.
Figure 12:
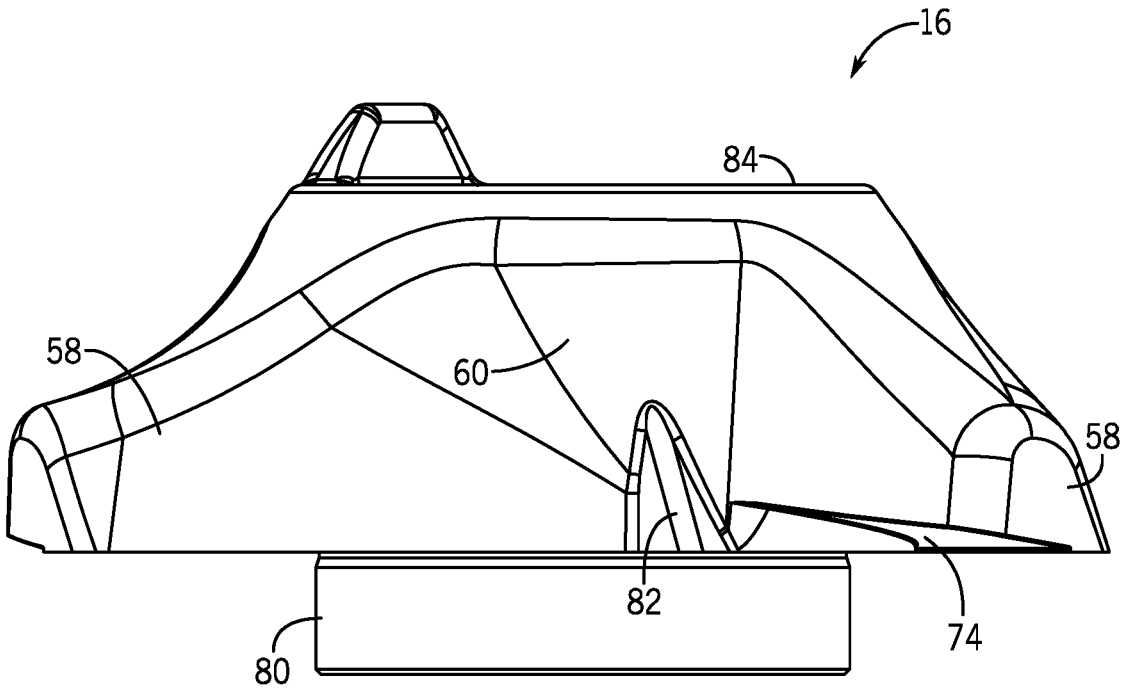
FIG. 12 is a side plan view of the cutting hub of FIG. 1.

The leading sidewall 52 may be disposed on the convex side of the cutting feature 32. As best illustrated in FIG. 9, the leading sidewall 52 may extend between and generally perpendicularly to the front and rear axial surfaces 20, 34. The trailing sidewall 54 may be disposed on the concave side of the cutting feature 32. As best illustrated in FIGS. 8-10, the trailing sidewall 54 may extend between the front and rear axial surfaces 20, 34, at an angle relative to each of the front and rear axial surfaces 20, 34. Specifically, the trailing sidewall 54 may extend from the front axial surface 20 toward the rear axial surface 34 at an angle with respect to the drive axis 12 such that the trailing sidewall 54 is angled in the direction of rotation 46 of the cutting hub 16 from the front axial surface 20 to the rear axial surface 34. As such, the cutting feature 32 may gradually widen from the front axial surface 20 to the rear axial surface 34, and a pair of cutting edges 56 is formed between the trailing sidewall 54 and the front axial surface 20. Specifically, the trailing sidewall 54 may define a pair of negative semi-frustoconical shaped surfaces 57 (i.e., each of the surfaces 57 form the outside of a semi-frustoconical shaped cavity) connected by a central semi-frustoconical shaped surface 59 that is oppositely-oriented (i.e., upside-down with respect to the semi-frustoconical shape of the surfaces 57). The pair of cutting edges 56 may be disposed at the narrow ends of the negative semi-frustoconical shaped surfaces 57, thereby providing two distinct cutting edges 56, separated by the central surface 59, for each cutting feature 32.

Figure 2:
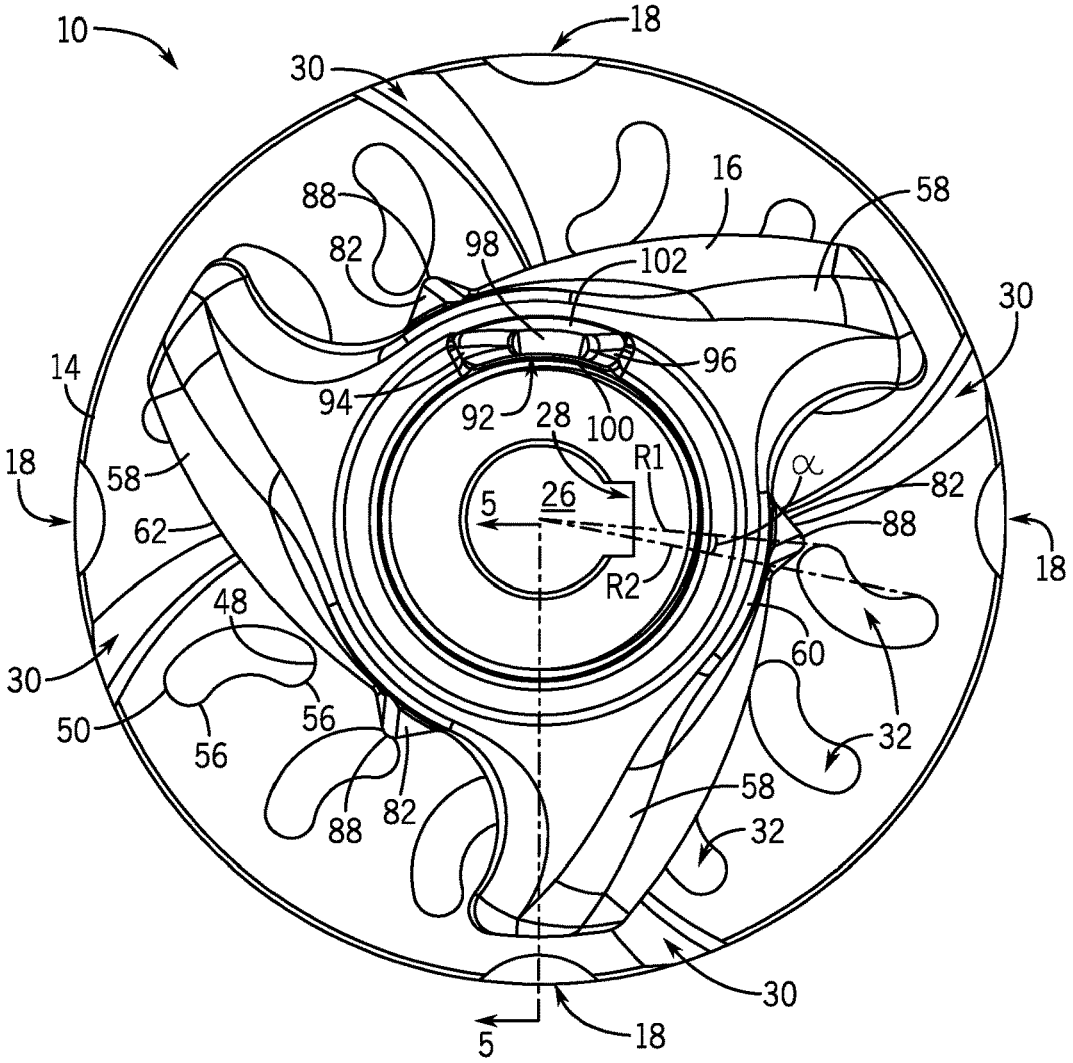
FIG. 2 is a front view of the cutting blade assembly of FIG. 1.

Referring now to FIG. 6, one of the pair of cutting edges 56 may be disposed proximate the inner end 48 of the cutting feature 32 and the other cutting edge 56 may be disposed proximate the outer end 50 of the cutting feature 32. Thus, the pair of cutting edges 56 may be radially separated from each other. Therefore, the pair of cutting edges 56 allows for debris to be cut multiple times each time a single cutting arm 58 of the cutting hub 16 passes over a single cutting feature 32. As shown in FIG. 2, the leading-most edge of the radially inner cutting edge 56 may be tangential to ray R1 and the leading-most edge of the radially outer cutting edge 56 may be tangential to ray R2. In one example, the ray R1 may be rotationally spaced about the drive axis 12 from the ray R2 by an angle α such that the cutting engagement between the cutting features 32 and the cutting hub 16 may be adapted to accommodate application-specific requirements by, for instance, altering the angle α (and/or the contour of the cutting arm 58) to adjust the cyclical timing of the cutting engagement.

As shown in FIGS. 2, 15A, 15B, and 15C the axial cutting action between the cutting plate 14 and the cutting hub 16 can be generally accomplished as axial cutting arms 58 of the cutting hub 16 rotate adjacent to the pair of cutting edges 56 in two separate cutting actions (e.g., a scissor-type, shearing action and a chipping-type action). For example, as the cutting hub 16 is rotated and one of the axial cutting arms 58 passes over one of the cutting features 32, the leading edge 62 of the cutting arm 58 first passes over the radially inner cutting edge 56 (see, e.g., FIG. 15A). As the leading edge 62 passes over the radially inner cutting edge 56, a scissor-type, shearing action occurs between the leading edge 62 and the radially inner cutting edge 56 due to the arrangement of the cutting feature 32 with respect to the cutting arm 58 (see, e.g., FIG. 15B). Specifically, the cutting feature 32 is arranged such that, as the cutting hub 16 rotates, the convex shape of the trailing sidewall 54, the convex shape of the leading edge 62 of the cutting arm 58, and the angle α between ray R1 and ray R2 provides that a majority of the radially inner cutting edge 56 is arranged close to parallel to the leading edge 62 of the cutting arm 58. With the close to parallel arrangement between the radially inner cutting edge 56 and the leading edge 62, the leading edge 62 gradually shears over the radially inner cutting edge 56.

Conversely, the cutting feature 32 is arranged such that, as the cutting hub 16 rotates, a majority of the radially outer cutting edge 56 may be arranged close to perpendicular, with only a radially outermost portion of the radially outer cutting edge 56 being disposed at or near parallel to the leading edge 62 of the cutting arm 58. As such, the leading edge 62 may shear over the portion of the radially outer cutting edge 56 that is close to perpendicular to the leading edge 62, and then abruptly passes over the end portion of the radially outer cutting edge 56 that is close to parallel with the leading edge 62 (see, e.g., FIG. 15C). The abrupt change in relative angles between the radially outer cutting edge 56 and the leading edge 62 may result in a chipping-type cutting action. As such, the scissor-type action and the chipping-type action may establish two separate zones of cutting engagement at the pair of cutting edges 56 as the cutting hub 16 rotates relative to the cutting plate 14.

The cutting hub 16 may include three circumferentially-spaced axial cutting arms 58 that may extend radially outward from a central, cylindrical hub portion 60. Each of the axial cutting arms 58 of the cutting hub 16 may have a leading edge 62 that is positioned adjacent to the front axial surface 20 of the cutting plate 14. As the cutting hub 16 rotates, the leading edges 62 of each axial cutting arm 58 may shear past the fixed pair of cutting edges 56 of the cutting features 32 of the cutting plate 14.

In some instances, the arrangement of the cutting features 32 on the cutting plate 14 and the spacing between the cutting arms 58 of the cutting hub 16 ensure that only one cutting arm 58 and one cutting feature 32 are performing a cutting action at any given time. This may allow for a more uniform torque on the pump motor, while also reducing starting torque on the pump motor in the case that debris is disposed between the cutting arm 58 and the cutting feature 32 when the pump motor is started.

Figure 3:
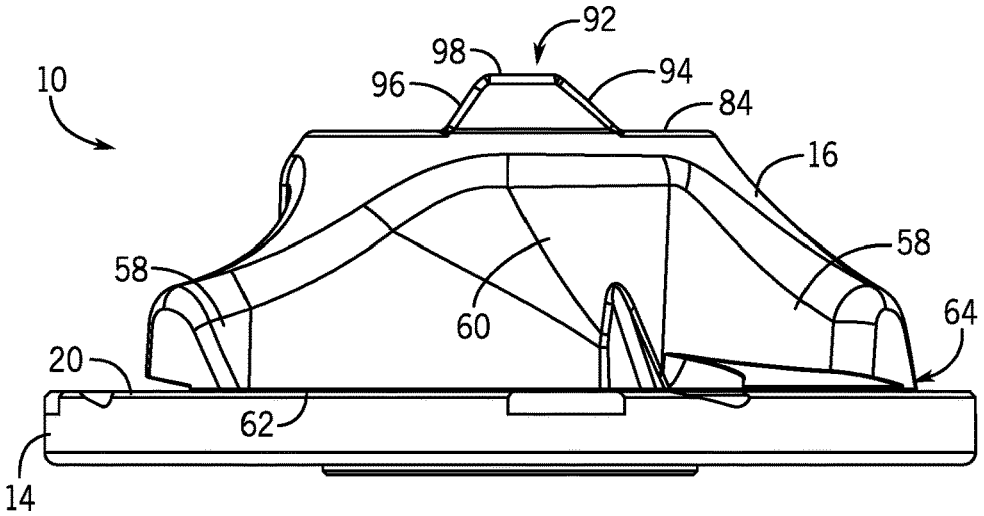
FIG. 3 is a side plan view of the cutting blade assembly of FIG. 1.
Figure 4:
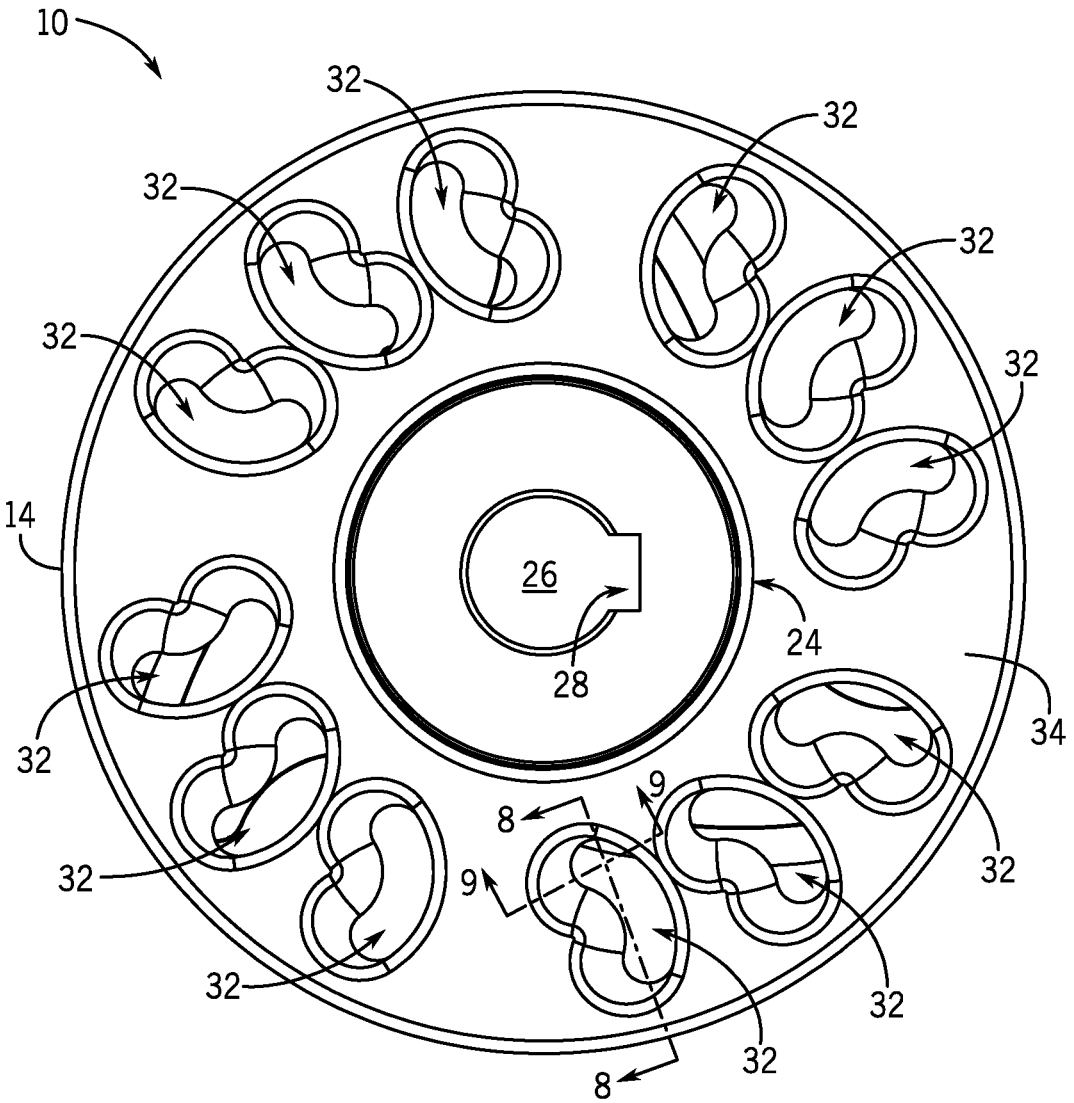
FIG. 4 is a rear view of the cutting blade assembly of FIG. 1.
Figure 5:
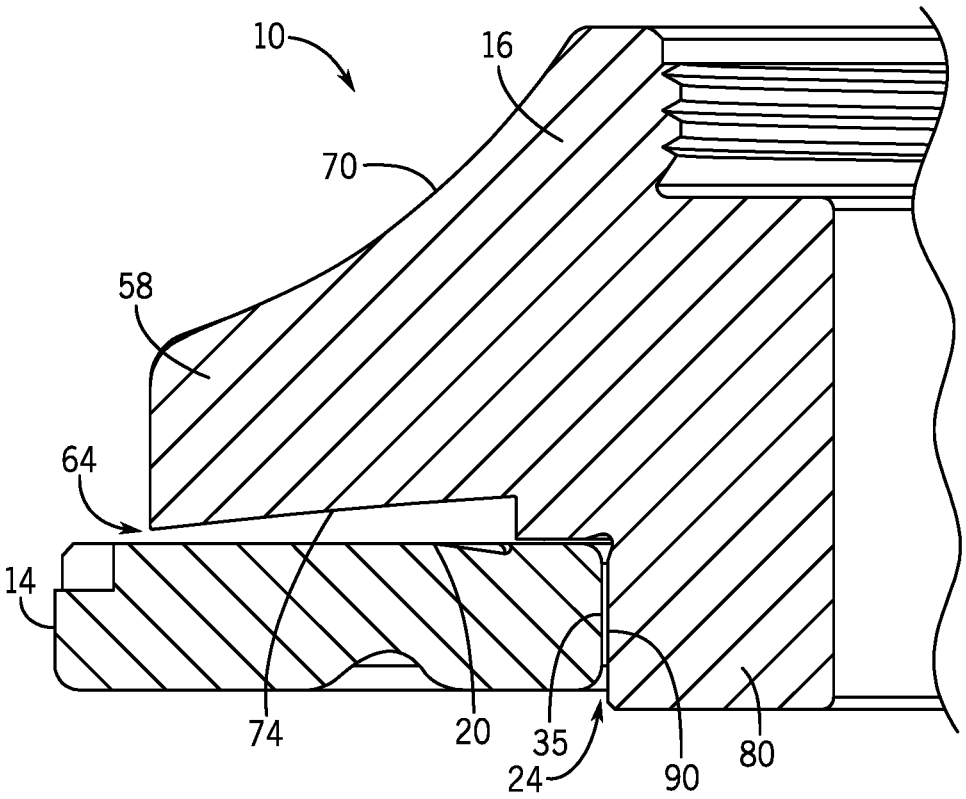
FIG. 5 is a partial cross-sectional view along line 5-5 of FIG. 2.

As shown in FIG. 3, a gap or spacing 64 between the leading edge 62 and the front axial surface 20 can be adjusted based on the particular application requirements, such as desired axial cut size and medium being processed. For example, in some instances, the gap or spacing 64 may be less than 0.2 mm.

As shown in FIGS. 5 and 10-12, each of the axial cutting arms 58 may taper from a wider and thicker base portion 66 adjacent the hub portion 60 to a narrower and thinner tip portion 68 at a distal end of the axial cutting arm 58. Each axial cutting arm 58 may have a generally arcuate front surface 70 and a generally planar rear surface 72. The front surface 70 may be rounded to aid in rejecting suspended debris that has not been sufficiently reduced in size by the axial cutting action. An undercut 74 may be formed in the rear surface 72 to create a low pressure zone on the back edge 76 of the axial cutting arm 58 to help prevent debris from being trapped or becoming stagnant as the axial cutting arm 58 rotates. The arcuate front surface 70 of the cutting arms 58 may also minimize the magnitude of a torque spike of the motor when debris comes into abrupt contact with the cutting hub 16.

The cutting hub 16 may further include a connection cap recess 78, a plate engagement portion 80 (shown in FIGS. 11 and 12), and a plurality of deflection fins 82. The connection cap recess 78 may be recessed into a front surface 84 of the hub portion 60. The connection cap recess 78 may be configured to receive and/or engage a corresponding connection cap (not shown) that is configured to engage the drive shaft of the motor to lock the cutting hub 16 into engagement with the cutting plate 14.

The plate engagement portion 80 may define a generally cylindrical shape that extends away from a rear surface 86 of the hub portion 60. The plate engagement portion 80 may have a diameter that corresponds to a diameter of the central opening 24 of the cutting plate 14. As such, the plate engagement portion 80 may be received within the central opening 24 of the cutting plate 14.

The plurality of deflection fins 82 may extend radially outward from the hub portion 60, at a lower end of the hub portion 60, between adjacent cutting arms 58. In some instances, the rear surface of each of the deflection fins 82 may be flush with the rear surface 86 of the hub portion. As best shown in FIG. 2, when the plate engagement portion 80 of the cutting hub 16 is received within the central opening 24 of the cutting plate 14, a distal tip 88 of each fin 82 extends radially outward, past the inner ends 42 of the deflection features 30, to approximately the inner ends 48 of the cutting features 32. As such, the fins 82 may be configured to urge debris away from the central opening 24 of the cutting plate 14 while the cutting hub 16 is rotated. Accordingly, with reference to FIG. 5, the fins 82 may aide in preventing debris from becoming lodged between the inwardly-facing radial wall 35 of the central opening 24 and an outwardly-facing radial wall 90 of the plate engagement portion 80, which can inhibit relative rotation between the cutting plate 14 and the cutting hub 16.

In the illustrated non-limiting example, there are three deflection fins 82 that may be evenly spaced around the circumference of the cutting hub 16. In other embodiments, the shape, number, and relative orientation of the deflection fins 82 may be altered to accommodate application-specific requirements.

Figure 13:
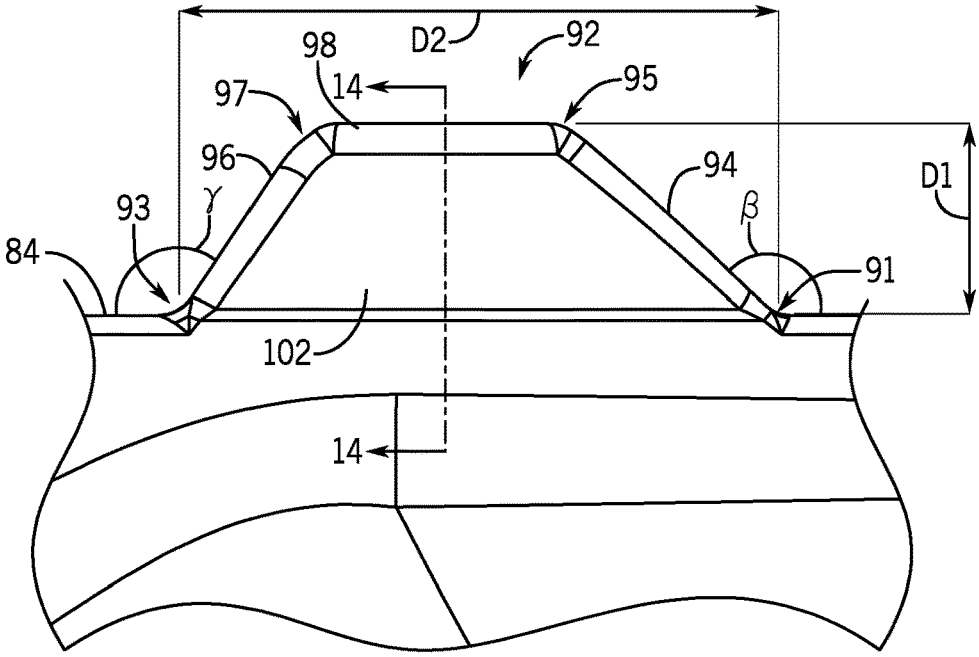
FIG. 13 is a detail view of a node of the cutting hub of FIG. 3.

With reference to FIGS. 3 and 13, the cutting hub 16 may further include a node 92 that is configured to direct debris away from the drive axis 12. The node 92 may extend axially from the front surface 84 of the hub portion 60 an axial distance D1. The node 92 may define a leading portion 94 and a trailing portion 96 that may be connected by an intermediate axial portion 98. The intermediate axial portion 98 may be substantially parallel to the front surface 84 of the hub portion 60. The node 92 may span a circumferential distance D2 from a leading lower corner 91 to a trailing lower corner 93. In some instances, the circumferential distance D2 may be about three times the axial distance D1, where "about" is within 10%. For example, the axial distance D1 may be about 5 mm and the circumferential distance D2 may be about 15 mm, where "about" is within 10%.

In some instances, the slope/angle of the leading portion 94 relative to the front surface 84 is more gradual than that of the trailing portion 96. For example, a leading angle β between the leading portion 94 and the front surface 84 of the hub portion 60 may be any angle between about 110-160 degrees, and preferably about 135 degrees, where "about" is within 10%. As another example, a trailing angle γ between the trailing portion 96 and the front surface 84 may be any angle between about 100-140 degrees, and preferably about 120 degrees, where "about" is within 10%. In other exemplary embodiments, the leading angle β may greater than 90 degrees and the trailing angle γ may be greater than 90 degrees.

Further, the node 92 may include a leading upper corner 95 and a trailing upper corner 97. In some instances, the leading upper corner 95 and the trailing upper corner 97 may have radii of curvature that are about three times the radii of curvature of the leading lower corner 91 and the trailing lower corner 93, where "about" is within 10%. For example, the leading upper corner 95 and the trailing upper corner 97 may each have a radius of curvature of between about 2-5 mm, and preferably about 3 mm, and the leading lower corner 91 and the trailing lower corner 93 may each have a radius of curvature of about 1-3 mm, and preferably about 1 mm, where "about" is within 10%.

Figure 14:
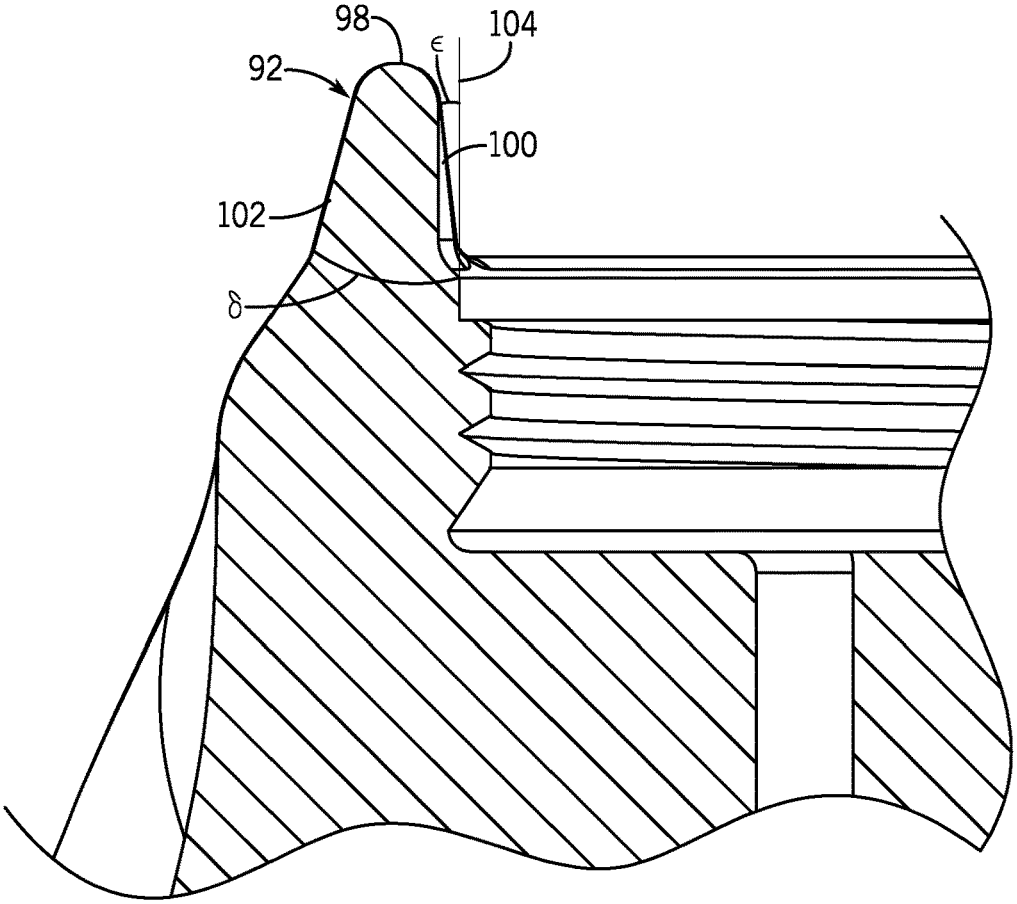
FIG. 14 is a partial cross-sectional view along line 14-14 of FIG. 13.
Figure 15A:
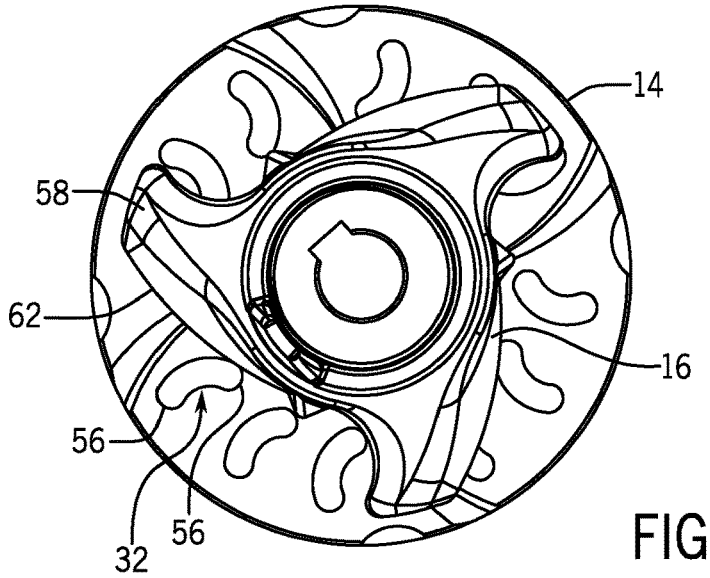
FIGS. 15A, 15B, and 15C are front plan views of the cutting blade assembly of FIG. 1.
Figure 15B:
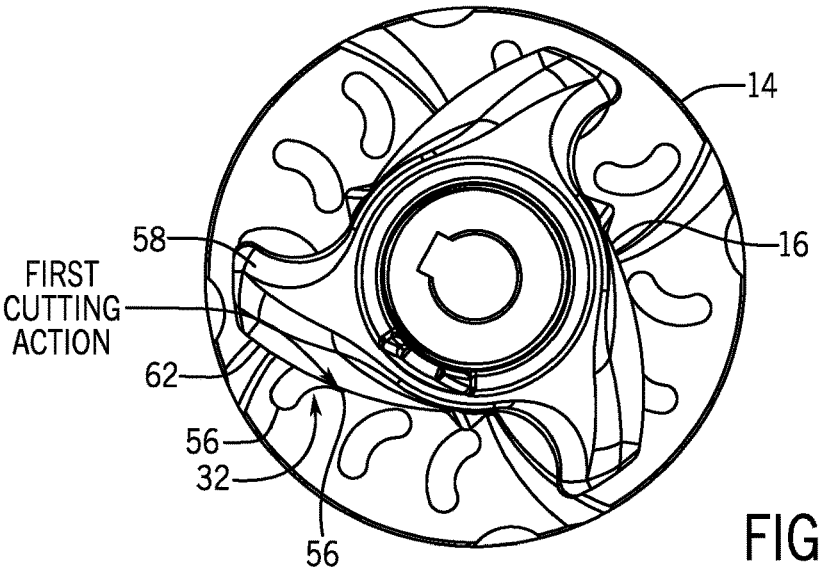
Figure 15C:
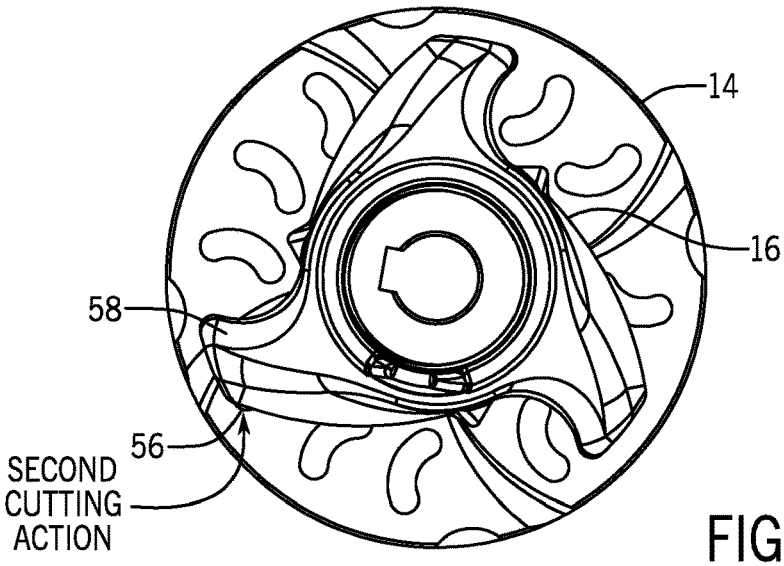

Referring now to FIG. 14, the node 92 may also define an interior surface 100 and an exterior surface 102 that may both generally taper toward the intermediate axial portion 98, with the exterior surface 102 skewed at a greater angle than the interior surface 100, relative to an axial direction 104 of the drive axis 12. For example, the exterior surface 102 may be arranged at an angle δ from the axial direction 104 and the interior surface 100 may be arranged at an angle ε from the axial direction 104. In some instances, the angle δ may be any angle between about 10-25 degrees and the angle ε may be any angle between about 0-2 degrees, where "about" is within 10%. As the cutting hub 16 rotates, the node 92 may be configured to deflect and reject debris away from the drive axis 12 and toward the various cutting features 32. With this node 92 form factor (e.g., elevation/cam profile), debris (e.g., cloths, wipes, etc.) that will otherwise surround the cutting rotor during suction, are preferably diverted and fed, for instance, step-by-step to the cutting features. This helps enable a more continuous cutting process without longer undercuts and reduced potential for excessive loading. In addition, the flow-optimized geometry of these node 92 features reduces and limits power loss during operation.

In the illustrated non-limiting example, there may be a single node 92 extending from the hub portion 60. In other embodiments, the placement, shape, number, and relative orientation of the node 92 may be altered to accommodate application-specific requirements.

Once the axial cutting action is complete, the resulting slurry may be urged by the rotating impeller of the fluid pump, through the internal manifold, toward the outlet of the pump housing. The illustrated construction of the cutting plate 14 and the cutting hub 16 (as shown in FIG. 2) provides a generally constant inlet area that improves the efficiency of the overall cutting blade application. For instance, the cross sectional area of the central opening 24 in the cutting plate 14 may be generally constant over the axial length of the central opening 24. The relatively constant inlet area minimizes the velocity changes of the fluid/slurry as it travels through the cutting blade assembly 10 and associated pump components. In the cutting blade assembly 10, the fluid speed may be increased as it passes into and through the cutting features 32, reduces slightly downstream of the cutting features 32, and maintains approximately the same velocity before reaching the impeller. The torque required to operate the cutting blade assembly 10 may be further minimized by the swept back configuration of the axial cutting arms 58. Furthermore, the cutting configuration employed in the axial cutting action may reduce the torque requirements as compared to a conventional cutting action. The reduction in typical cut size achieved by having two separate cutting edges 56 for each cutting feature 32 may also reduce the torque required.

It will be understood that a variety of materials, including metals, plastics, and composites may be used to construct the cutting blade assembly given the specific application requirements.

It will be appreciated by those skilled in the art that while the invention has been described above in connection with particular embodiments and examples, the invention is not necessarily so limited, and that numerous other embodiments, examples, uses, modifications, and departures from the embodiments, examples, and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A cutting blade assembly configured to be coupled to a fluid pump, the cutting blade assembly comprising:

a cutting plate having a front axial surface, an opening, and a plurality of cutting holes, each of the plurality of cutting holes defining at least one cutting edge; and a cutting hub disposed at least partially within the opening of the cutting plate and having a cutting arm and a fin, the cutting arm being adjacent to the front axial surface and defining an arcuate front surface having a leading edge, the fin being adjacent to the front axial surface and proximate to the cutting arm;

wherein, when the cutting plate and the cutting hub are rotated relative to each other, the leading edge of the cutting arm passes adjacent to the plurality of cutting holes so that the relative rotation of the cutting plate and the cutting hub defines a cutting action between the leading edge and the at least one cutting edge and the fin are configured to urge debris away from the opening of the cutting plate.

2. The cutting blade assembly of claim 1, wherein the at least one cutting edge is a pair of cutting edges.

3. The cutting blade assembly of claim 2, wherein the pair of cutting edges are radially separated from each other, thereby allowing for multiple cuttings actions to be defined each time the leading edge of the cutting arm passes over one of the plurality of cutting holes.

4. The cutting blade assembly of claim 2, wherein each cutting hole of the plurality of cutting holes comprises a C-shaped through hole extending through the cutting plate from the front axial surface to a rear axial surface of the cutting plate.

5. The cutting blade assembly of claim 2, wherein each cutting hole of the plurality of cutting holes is approximately equidistant from the opening and a radial edge of the cutting plate.

6. The cutting blade assembly of claim 2, wherein each one of the pair of cutting edges is disposed on opposite ends of the corresponding cutting hole.

7. The cutting blade assembly of claim 2, wherein the cutting plate further includes a plurality of deflection features configured to deflect debris radially outward away from the opening when the cutting hub is rotated relative to the cutting plate.

8. The cutting blade assembly of claim 7, wherein each of the deflection features is gradually recessed into the front axial surface from an arcuate leading edge that is flush with the front axial surface to an arcuate trailing edge that is recessed into the front axial surface, thereby forming an angled lower surface.

9. The cutting blade assembly of claim 8, wherein each of the deflection features includes an inner end proximate the opening and an outer end at a radial edge of the cutting plate, and each of the deflection features gradually widens from the inner end to the outer end.

10. The cutting blade assembly of claim 9, wherein the arcuate leading edge defines a leading radius of curvature and the arcuate trailing edge defines a trailing radius of curvature that is different from the leading radius of curvature.

* * * * *